US008844921B2

(12) United States Patent
Okumura

(10) Patent No.: US 8,844,921 B2
(45) Date of Patent: Sep. 30, 2014

(54) SHEET POST-PROCESSING DEVICE, AND IMAGE FORMING APPARATUS INCLUDING SHEET POST-PROCESSING DEVICE

(71) Applicant: KYOCERA Document Solutions Inc., Osaka (JP)

(72) Inventor: Keiji Okumura, Osaka (JP)

(73) Assignee: KYOCERA Document Solutions, Inc., Osaka-shi (JP)

( * ) Notice: Subject to any disclaimer, the term of this patent is extended or adjusted under 35 U.S.C. 154(b) by 0 days.

(21) Appl. No.: 13/898,367

(22) Filed: May 20, 2013

(65) Prior Publication Data

US 2013/0313771 A1 Nov. 28, 2013

(30) Foreign Application Priority Data

May 23, 2012 (JP) ..... 2012-117919

(51) Int. Cl.

| | |
|---|---|
| ***B65H 37/04*** | (2006.01) |
| ***B42C 1/12*** | (2006.01) |
| ***B42B 4/00*** | (2006.01) |
| ***B42B 5/00*** | (2006.01) |

(52) U.S. Cl.

CPC . *B42B 5/00* (2013.01); *B42C 1/125* (2013.01); *B42B 4/00* (2013.01)

USPC ..... 270/58.11; 270/58.08; 399/410

(58) Field of Classification Search

USPC ..... 270/58.08, 58.11; 399/410

See application file for complete search history.

(56) References Cited

U.S. PATENT DOCUMENTS

| | | | | |
|---|---|---|---|---|
| 5,104,785 | A * | 4/1992 | Ichikawa et al. | 430/569 |
| 5,112,034 | A * | 5/1992 | Uto et al. | 270/58.12 |
| 5,765,824 | A * | 6/1998 | Kawano et al. | 270/58.11 |
| 6,219,503 | B1 * | 4/2001 | Miyake et al. | 399/85 |
| 6,315,288 | B1 * | 11/2001 | Sugishima et al. | 271/303 |
| 6,332,606 | B1 * | 12/2001 | Seki | 270/59 |
| 7,413,178 | B2 * | 8/2008 | Fujii et al. | 270/58.11 |
| 7,584,948 | B2 * | 9/2009 | Fujii et al. | 270/58.11 |
| 7,900,905 | B2 * | 3/2011 | Kiriyama | 270/58.1 |
| 8,246,032 | B2 * | 8/2012 | Nakajima | 270/58.01 |
| 8,292,285 | B2 * | 10/2012 | Yokoya et al. | 270/58.31 |
| 8,511,665 | B2 * | 8/2013 | Iwata et al. | 270/58.31 |
| 8,690,143 | B2 * | 4/2014 | Nakamura | 270/58.09 |
| 2005/0082747 | A1 | 4/2005 | Tamura et al. | |
| 2011/0274517 | A1 | 11/2011 | Okumura | |

FOREIGN PATENT DOCUMENTS

| | | | |
|---|---|---|---|
| JP | 11278734 | A | 10/1999 |
| JP | 2005075549 | A | 3/2005 |
| JP | 2011184177 | A | 9/2011 |

* cited by examiner

*Primary Examiner* — Patrick Mackey

(74) *Attorney, Agent, or Firm* — Alleman Hall McCoy Russell & Tuttle LLP

(57) ABSTRACT

A sheet post-processing apparatus according to one aspect of the present disclosure includes a switching member, a stapler, and a movement driving portion. The switching member switches the conveying direction of a sheet introduced from an image forming apparatus. The stapler staples a bundle of sheets obtained by performing stacking processing for a plurality of the sheets introduced from the image forming apparatus. The movement driving portion moves the stapler. Further, the stapler operates the switching member by being moved by the movement driving portion, thereby switching the conveying direction of the sheet.

16 Claims, 14 Drawing Sheets

SHEET POST-PROCESSING DEVICE, AND IMAGE FORMING APPARATUS INCLUDING SHEET POST-PROCESSING DEVICE

INCORPORATED BY REFERENCE

This application is based upon and claims the benefit of priority from the corresponding Japanese Patent Application No. 2012-117919 filed on May 23, 2012, the entire contents of which are incorporated herein by reference.

BACKGROUND

The present disclosure relates to a sheet post-processing apparatus that performs post-processing for a sheet introduced from an image forming apparatus, and to an image forming apparatus including the sheet post-processing apparatus.

Conventionally, as a post-processing apparatus for a sheet having an image formed thereon by an image forming apparatus such as a copy machine or a multifunction peripheral, a post-processing apparatus is known that includes a stapling processing portion that performs stapling processing of driving a staple into a bundle of sheets obtained by stacking processing for a plurality of sheets introduced from an image forming apparatus, an other-processing portion (for example, a processing portion that performs perforation processing (punching processing) for the sheet and folding processing such as double-folding (middle-folding) or triple-folding for the sheet (the bundle of sheets)), and a switching member that switches the conveying direction of the sheet for sending the sheet (the bundle of sheets) to these processing portions.

In such a sheet post-processing apparatus, in general, the switching member that switches the conveying direction of a sheet is configured to perform a switching action (operation) for the conveying direction by using a dedicated driving source for switching the conveying direction, such as a motor or an electromagnetic solenoid, for example.

SUMMARY

A sheet post-processing apparatus according to one aspect of the present disclosure includes a switching member, a stapler, and a movement driving portion.

The switching member switches the conveying direction of a sheet introduced from an image forming apparatus. The stapler staples a bundle of sheets obtained by performing stacking processing for a plurality of the sheets introduced from the image forming apparatus. The movement driving portion moves the stapler. Further, the stapler operates the switching member by being moved by the movement driving portion, thereby switching the conveying direction of the sheet.

An image forming apparatus according to another aspect of the present disclosure includes an image forming apparatus main body having an image forming portion that forms an image on a sheet, and a sheet post-processing apparatus. The sheet post-processing apparatus includes a switching member, a stapler, and a movement driving portion. The switching member switches the conveying direction of the sheet introduced from the image forming apparatus. The stapler staples a bundle of the sheets obtained by performing stacking processing for a plurality of the sheets introduced from the image forming apparatus. The movement driving portion moves the stapler. Further, the stapler operates the switching member by being moved by the movement driving portion, thereby switching the conveying direction of the sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, a sheet post-processing apparatus 1 of an embodiment of the present disclosure will be described with reference to FIGS. 1 to 5.

Figure 1:
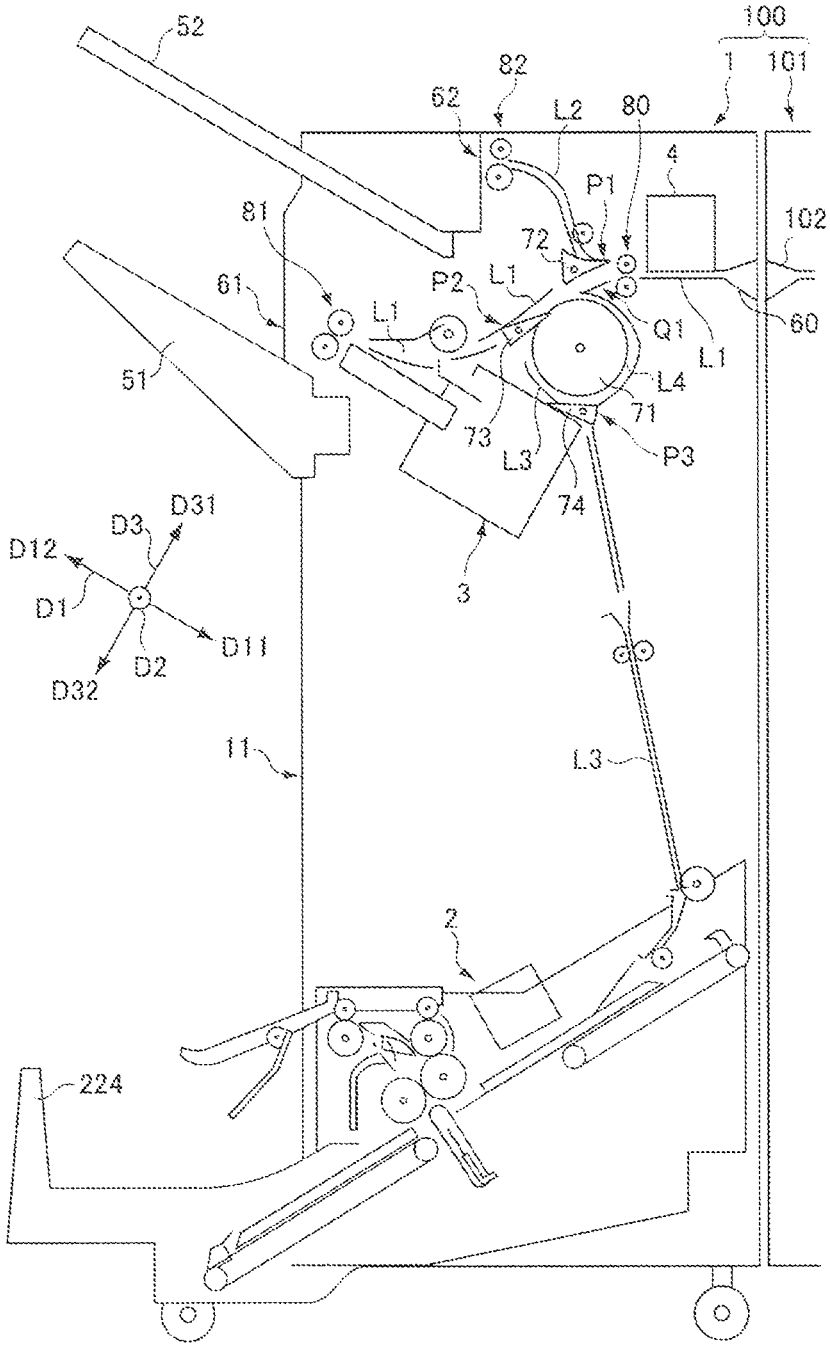
FIG. 1 is a schematic sectional view for explaining the schematic configuration of a sheet post-processing apparatus of an embodiment of the present disclosure.

As shown in FIG. 1, a multifunction peripheral 100 as an image forming apparatus of the present disclosure includes a multifunction peripheral main body 101 as an image forming apparatus main body, having an image forming portion (not shown) that forms an image on a sheet T (see FIGS. 7A and 7B), and a sheet post-processing apparatus 1 of the present embodiment.

The multifunction peripheral main body 101 includes the image forming portion (not shown) that forms an image on a sheet T such as a paper sheet, and a main body discharge portion 102 that discharges the sheet T having an image formed (printed) thereon by the image forming portion, to the sheet post-processing apparatus 1 or the like.

As shown in FIG. 1, the sheet post-processing apparatus 1 introduces (carries in) a sheet T having an image formed thereon by the multifunction peripheral main body 101 and discharged from the multifunction peripheral main body 101, into a housing 11 of the sheet post-processing apparatus 1, through a carry-in portion 60 provided at an upper portion on the right side surface of the sheet post-processing apparatus 1. Then, the sheet post-processing apparatus 1 performs predetermined post-processing such as stapling processing or folding processing for the introduced sheet T.

The sheet post-processing apparatus 1 includes a sheet folding processing portion 2, a stapling processing portion 3, a punching portion 4, a main discharge tray 51, and a sub discharge tray 52. In addition, the sheet post-processing apparatus 1 includes the carry-in portion 60, a first conveying path L1, a second conveying path L2, a third conveying path L3, a fourth conveying path L4, a first branch portion P1, a second branch portion P2, a third branch portion P3, a first merging portion Q1, a main discharge portion 61, a sub discharge portion 62, a waiting drum 71, various switching members (including switching claws 72 to 74), and various rollers or roller pairs.

First, a configuration for conveying a sheet T will be described.

The carry-in portion 60 is a portion into which a sheet T discharged from the main body discharge portion 102 of the multifunction peripheral main body 101 is carried.

The first conveying path L1 conveys the sheet T carried in (introduced) through the carry-in portion 60, to the main discharge portion 61. Then, the sheet T is discharged from the main discharge portion 61 to the main discharge tray 51.

The second conveying path L2 branches from the first conveying path L1, at the first branch portion P1. The second conveying path L2 conveys the sheet T proceeding thereto at the first branch portion P1, to the sub discharge portion 62. Then, the sheet T is discharged from the sub discharge portion 62 to the sub discharge tray 52.

The third conveying path L3 branches from the first conveying path L1 at the second branch portion P2, and extends to the sheet folding processing portion 2. The second branch portion P2 is positioned on the downstream side in the conveying direction relative to the first branch portion P1 on the first conveying path L1.

The fourth conveying path L4 branches from the third conveying path L3 at the third branch portion P3, curves along the circumference of the waiting drum 71, and then merges into the first conveying path L1 at the first merging portion Q1.

The first merging portion Q1 is positioned between the first branch portion P1 and the second branch portion P2 on the first conveying path L1.

A first intermediate roller pair 80 is provided on the upstream side in the conveying direction relative to the first branch portion P1 on the first conveying path L1. The first intermediate roller pair 80 sends forth a sheet T conveyed on the upstream side in the conveying direction relative to the first branch portion P1 on the first conveying path L1, to the downstream side in the conveying direction.

The first switching claw 72 is provided at the first branch portion P1, and switches the conveyance destination of a sheet T conveyed on the first conveying path L1 so as to keep the first conveying path L1 or change to the second conveying path L2.

Figure 2:
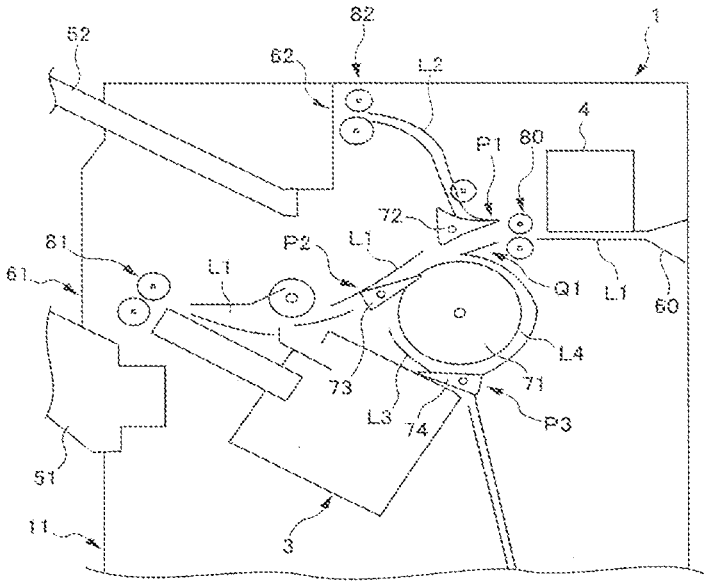
FIG. 2 is an enlarged sectional view of a specific part showing the state for conveying a sheet introduced into the sheet post-processing apparatus shown in FIG. 1 to a stapling processing portion.
Figure 3:
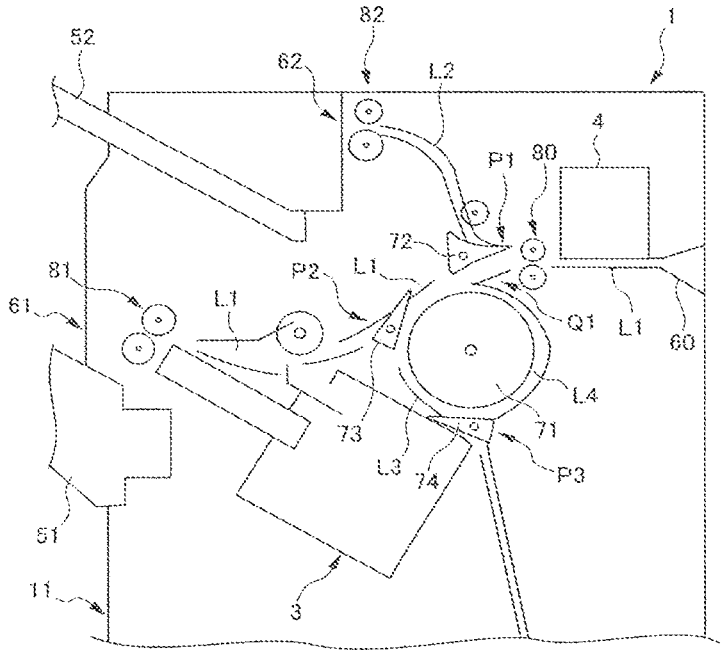
FIG. 3 is an enlarged sectional view of a specific part showing the state for causing a sheet introduced into the sheet post-processing apparatus shown in FIG. 1 to wait aside.

The second switching claw 73 is provided at the second branch portion P2, and switches the conveyance destination of the sheet T conveyed on the first conveying path L1 so as to keep the first conveying path L1 as shown in FIG. 2 or change to the second conveying path L3 as shown in FIG. 3.

Figure 4:
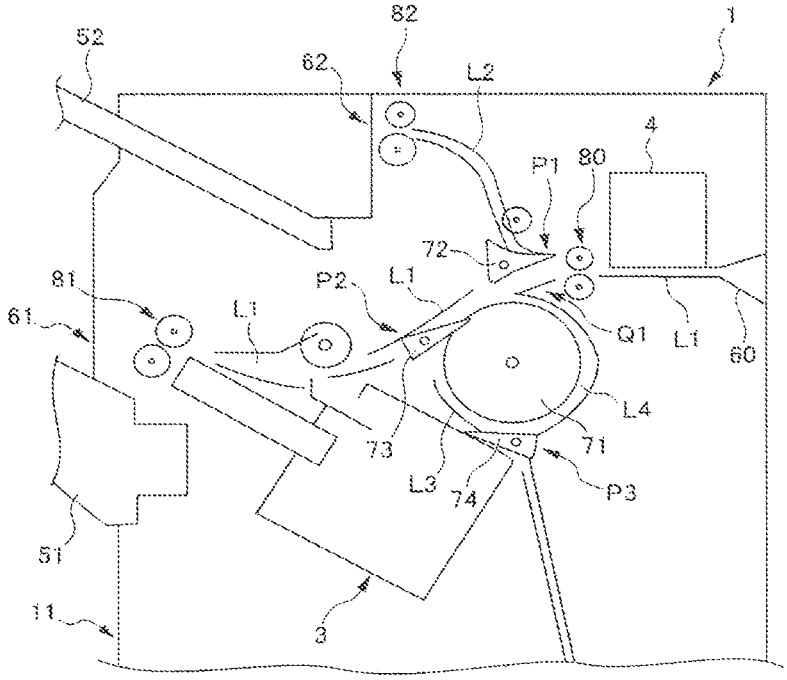
FIG. 4 is an enlarged sectional view of a specific part showing a stacking processing state for overlaying a sheet introduced into the sheet post-processing apparatus shown in FIG. 1 on a waiting sheet.
Figure 5:
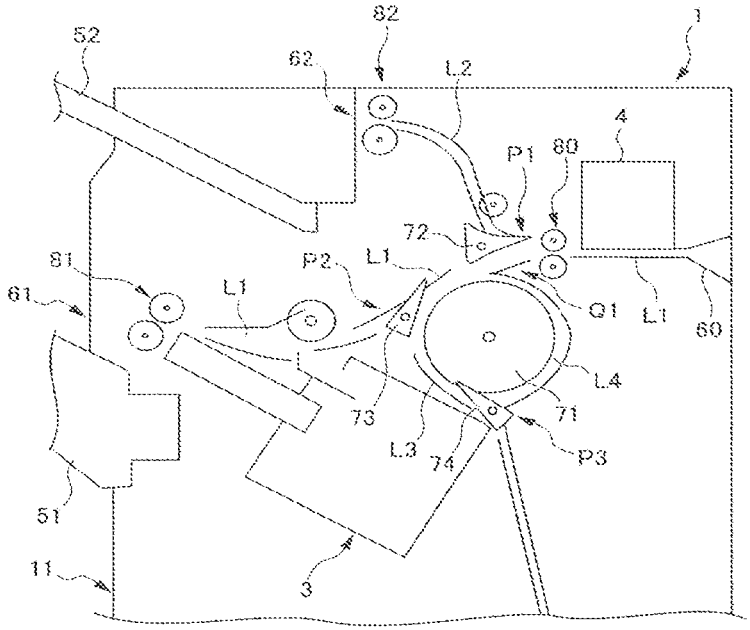
FIG. 5 is an enlarged sectional view of a specific part showing the state for conveying a sheet introduced into the sheet post-processing apparatus shown in FIG. 1 to a sheet folding processing portion.

The third switching claw 74 as a switching member is provided at the third branch portion P3, and switches the conveyance destination of a sheet T conveyed on the third conveying path L3 so as to keep the third conveying path L3 leading to the sheet folding processing portion 2 as shown in FIG. 5 or change to the fourth conveying path L4 as shown in FIG. 4.

The punching portion 4 is provided so as to face to a region between the carry-in portion 60 and the first branch portion P1 on the first conveying path L1. The punching portion 4 performs perforation processing for a sheet T at a predetermined timing.

A main discharge portion roller pair 81 is provided at the end of the first conveying path L1 and in the vicinity of the main discharge portion 61. The main discharge portion roller pair 81 sends forth a sheet T conveyed through the end of the first conveying path L1, to the main discharge tray 51. In addition, in the case of sending forth a sheet T to the stapling processing portion 3, the main discharge portion roller pair 81 is separated from each other to release its nip. Then, the sheet T is sent forth to the stapling processing portion 3 by a sheet sending mechanism not shown.

The main discharge tray 51 receives the sheet T discharged from the main discharge portion 61 by the main discharge portion roller pair 81. The main discharge tray 51 mainly receives a bundle of sheets T discharged from the main discharge portion 61 after the stapling processing portion 3 has performed stapling processing. The main discharge tray 51 sequentially descends from its uppermost position in accordance with increase in the number of discharged bundles of sheets T. Then, the main discharge tray 51 ascends as the bundles of sheets T are removed from the main discharge tray 51, to return to its reference position.

It is noted that a sheet T discharged without being processed by the post-processing in the sheet post-processing apparatus 1 or a sheet T processed by only the punching processing can be also received on the main discharge tray 51.

A sub discharge portion roller pair 82 is provided at the end of the second conveying path L2 and in the vicinity of the sub discharge portion 62. The sub discharge portion roller pair 82 sends forth a sheet T conveyed through the end of the second conveying path L2, to the sub discharge tray 52. The sub discharge tray 52 receives a sheet T discharged from the sub discharge portion 62 by the sub discharge portion roller pair 82. The sub discharge tray 52 mainly receives a sheet T discharged without being processed by the post-processing in the sheet post-processing apparatus 1 or a sheet T processed by only the perforation processing. The sheet folding processing portion 2 is provided at a lower portion of the housing 11. More specifically, the sheet folding processing portion 2 is provided at the lowermost portion of the housing 11 of the sheet post-processing apparatus 1. The sheet folding processing portion 2 is provided on the downstream side in the conveying direction on the third conveying path L3, and mainly performs folding processing for a bundle of sheets T. If a user selects folding processing, the sheet folding processing portion 2 performs folding processing such as double-folding or triple-folding for a bundle of sheets T, and discharges the sheets T to a lower discharge tray 224 provided at a lower portion on one side surface of the housing 11 of the sheet post-processing apparatus 1.

The stapling processing portion 3 performs stacking processing of stacking a plurality of sheets T to form a bundle of the sheets T. The stapling processing portion 3 performs various types of stapling processing such as end-portion stapling of stapling the end portion of the bundle of sheets T formed by the stacking processing. For example, as shown in FIG. 7, the end-portion stapling includes two-point stapling processing of stapling the back end of the bundle of sheets T at two positions in the vicinity of the center along the longitudinal direction, and end stapling processing of stapling the end portion of the bundle of sheets T at one position in the vicinity of one corner. For example, the end stapling processing includes oblique end stapling processing of obliquely stapling one portion at an angle of 45 degrees with respect to an edge Te of the sheet T, and parallel end stapling processing of stapling one portion in parallel with the longitudinal direction of the sheet T (along the edge Te of the sheet T). A bundle of sheets T processed by the stacking processing or the end-portion stapling is discharged from the main discharge portion 61 by the main discharge portion roller pair 81.

The waiting drum 71 conveys a sheet T diverging from the first conveying path L1 and then conveyed through the third conveying path L3, to the fourth conveying path L4, thereby circulating the sheet T via the first conveying path L1. Thus, the sheet T can temporarily wait aside. In the case of continuously performing the stapling processing for a plurality of bundles of sheets T, while the stapling processing portion 3 is performing the stapling processing for the preceding bundle of sheets T, the waiting drum 71 winds one or a plurality of sheets T of the next bundle on the surface of the waiting drum 71, thereby making them wait aside. Owing to the operation of the waiting drum 71, it becomes unnecessary to temporarily stop discharge of the sheets T from the multifunction peripheral main body 101 during the stapling processing, thereby improving the productivity.

Next, with reference to FIGS. 6 to 16, the configuration of the stapling processing portion 3 and the details of an operation mechanism 36 that operates the third switching claw 74 in the sheet post-processing apparatus 1 of the present embodiment will be described.

As shown in FIG. 1, the stapling processing portion 3 according to the present embodiment is provided at an upper portion of the housing 11 of the sheet post-processing apparatus 1. More specifically, the stapling processing portion 3 is provided on the downstream side in the conveying direction on the first conveying path L1. The stapling processing portion 3 is a portion that performs the stacking processing for a plurality of sheets T and performing the stapling processing by driving a staple SP into the bundle of sheets T (see FIGS. 7A and 7B). If a user selects the stapling processing, the stapling processing portion 3 performs the stapling processing for a bundle of sheets T. The bundle of sheets T processed by the stapling processing is discharged to the main discharge tray 51 provided at an upper portion on one side surface of the housing 11 of the sheet post-processing apparatus 1.

It is noted that in the following description, for convenience, the term "sheet T" includes a bundle of sheets T. In addition, the direction in which a sheet T is conveyed to the stapling processing portion 3 or the direction in which a sheet T is conveyed from the stapling processing portion 3 is referred to as a "conveying direction D1". Of the conveying direction D1, the direction to approach the stapling processing portion 3 is referred to as a "conveying downstream direction D11", and the direction to depart from the stapling processing portion 3 is referred to as a "conveying upstream direction D12".

The direction perpendicular to the conveying direction D1 (in detail, the direction that is the width direction of a sheet T and perpendicular to the conveying direction D1) is referred to as a "perpendicular direction D2". Of the perpendicular direction D2, the direction toward the near side of the sheet post-processing apparatus 1 (the near side in FIG. 1) is referred to as a "perpendicular near-side direction D21" and the direction toward the back side of the sheet post-processing apparatus 1 (the back side in FIG. 1) is referred to as a "perpendicular back-side direction D22".

The direction perpendicular to the conveying direction D1 and the perpendicular direction D2 (in other words, the direction perpendicular to a D1-D2 plane or the thickness direction of the sheet T) is referred to as an "up-down direction D3". Of the up-down direction D3, the upward direction is referred to as an "up direction D31" and the downward direction is referred to as a "down direction D32".

As shown in FIGS. 6 to 16, the stapling processing portion 3 includes a stapler 31, a movement table (not shown), a movement driving portion 35 that moves the movement table in the perpendicular direction D2, a base member 33, and the operation mechanism 36 that operates the third switching claw 74.

Figure 9:
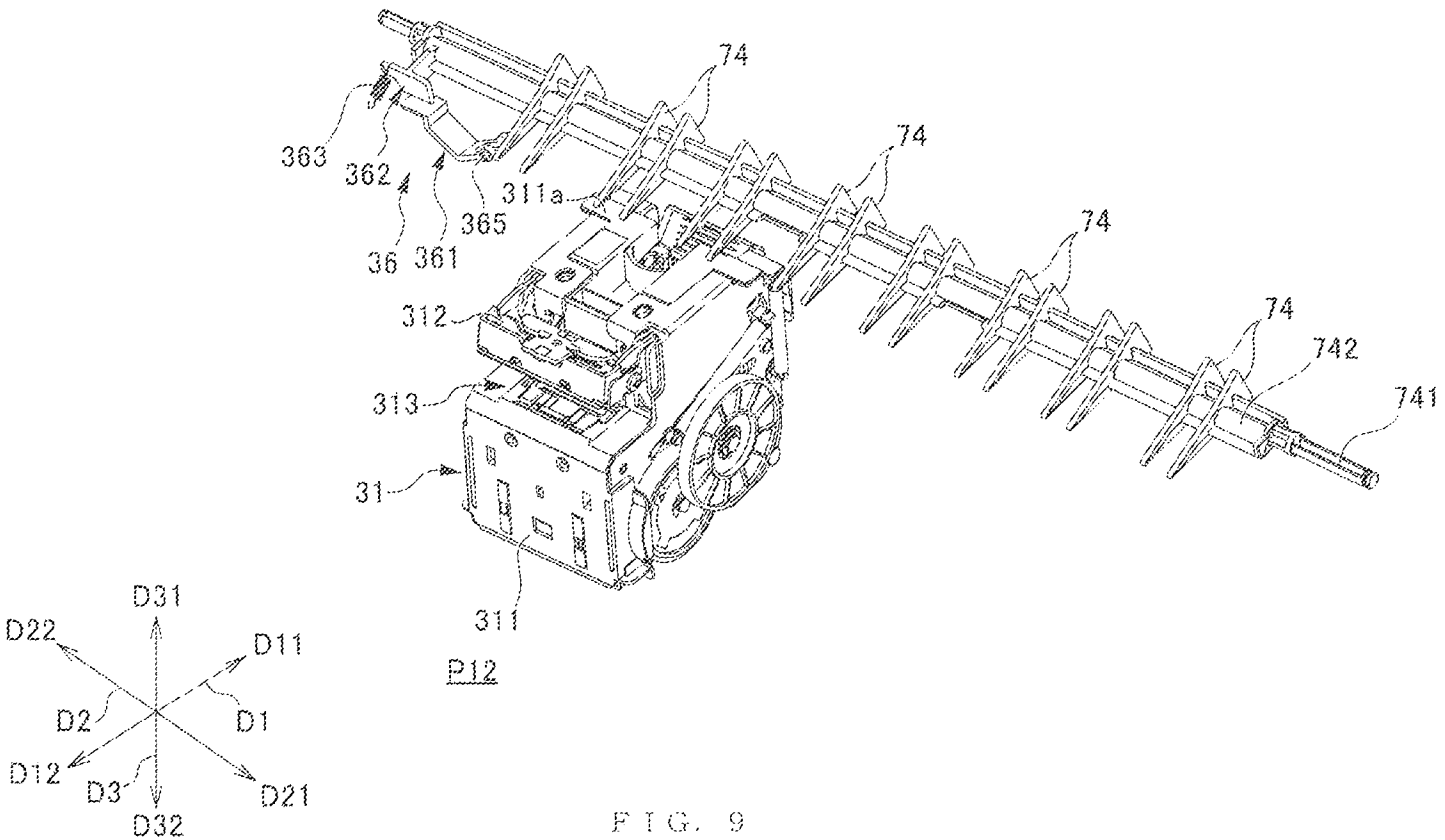
FIG. 9 is a diagram showing the state in which a conveying guide and a base member composing a third conveying path are removed from the state shown in FIG. 8.

The stapler 31 is a device that staples, with a staple SP, a bundle of sheets T obtained by the stapling processing portion 3 performing the stacking processing for a plurality of sheets T. As shown in FIG. 9 and the like, the stapler 31 includes a stapler main body portion 311 having a driving portion for a staple SP, a clincher 312, and a sheet insertion concave portion 313. The stapler 31 holds the sheet T inserted into the sheet insertion concave portion 313, between the stapler main body portion 311 and the clincher 312, thereby stapling the sheet T with a staple SP.

The movement table is joined with a lower portion of the stapler 31. The base member 33 is provided at an upper portion of the stapler 31. A conveying guide 34 forms the lower surface of the third conveying path L3 in the vicinity of the third branch portion P3.

The movement driving portion 35 drives to move the stapler 31 in the perpendicular direction D2 via the movement table. The movement driving portion 35 is capable of linearly moving the stapler 31 in the perpendicular direction D2 via the movement table and the like, and mechanically keeping the state in which the stapler 31 is inclined by a predetermined angle with respect to the conveying direction D1 of the sheet T by rotating the stapler 31 around a virtual rotational axis extending in the up-down direction D3.

By the sheet sending mechanism, a sheet T to be processed by the stapling processing is conveyed to the stapler 31. The conveying direction D1 of the sheet T is oblique to the vertical direction of the sheet post-processing apparatus 1 (the vertical direction in FIG. 1). The conveying downstream direction D11 is the direction toward the lower right side of the sheet post-processing apparatus 1.

Figure 7A:
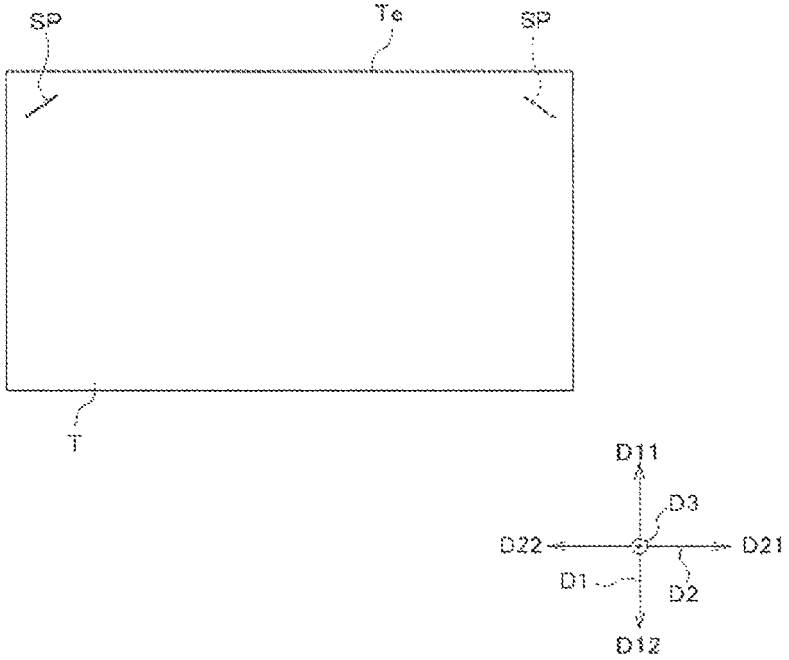
FIG. 7A is a diagram for explaining oblique end stapling processing, among various types of stapling processing for a bundle of sheets performed by the sheet post-processing apparatus shown in FIG. 1.
Figure 7B:
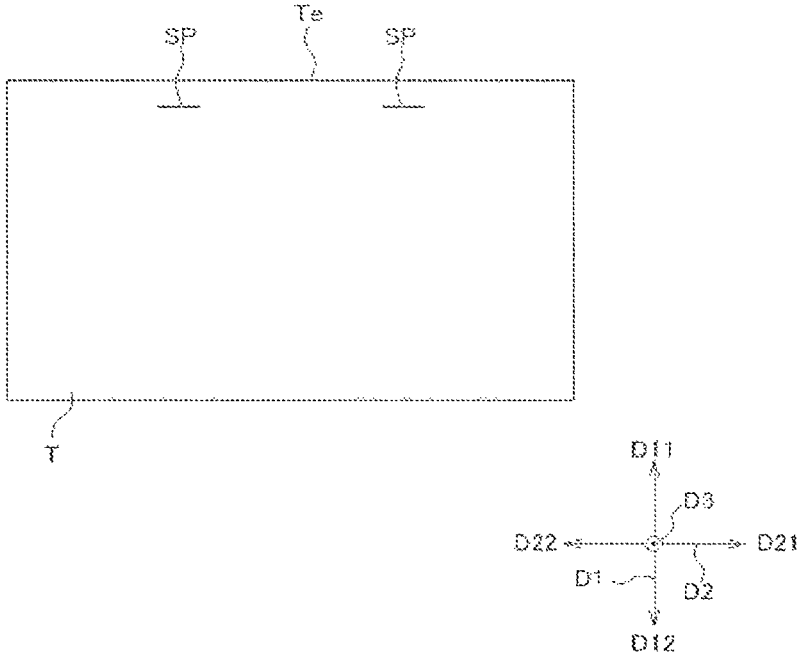
FIG. 7B is a diagram for explaining two-point stapling processing, among various types of stapling processing for a bundle of sheets performed by the sheet post-processing apparatus shown in FIG. 1.
Figure 8:
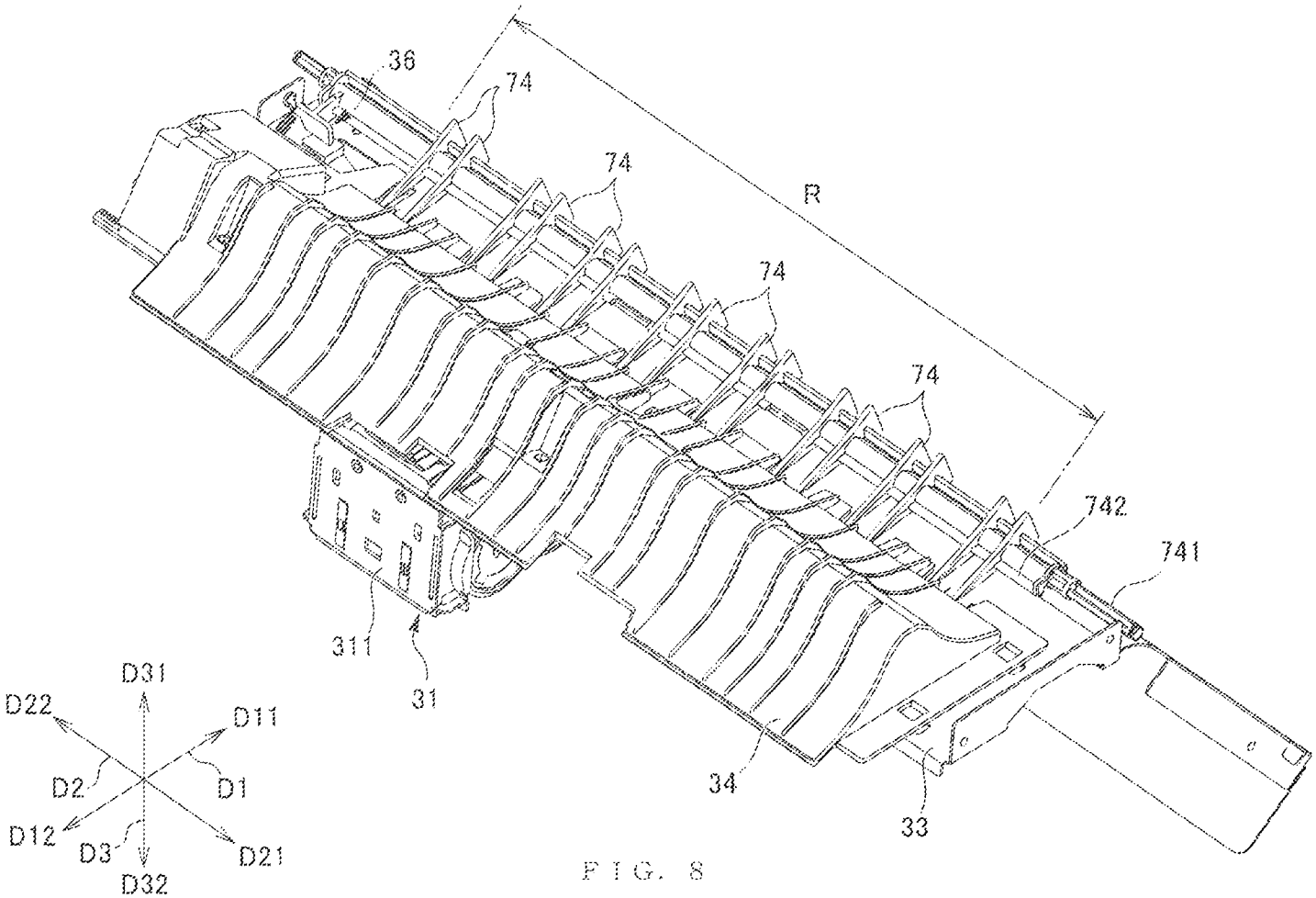
FIG. 8 is a perspective view showing the state in which the stapler of the sheet post-processing apparatus shown in FIG. 1 is present at a home position, as seen from above.

The stapler 31 of the present embodiment is capable of executing the oblique end stapling processing of driving a staple SP in the vicinity of a corner of a sheet T such that the staple SP is inclined by a predetermined angle with respect to the conveying direction D1 of the sheet Ton a D1-D2 plane as shown in FIG. 7A, and the two-point stapling processing of driving staplers SP at two positions along the edge Te in the perpendicular direction D2 of a sheet T as shown in FIG. 7B.

Figure 6:
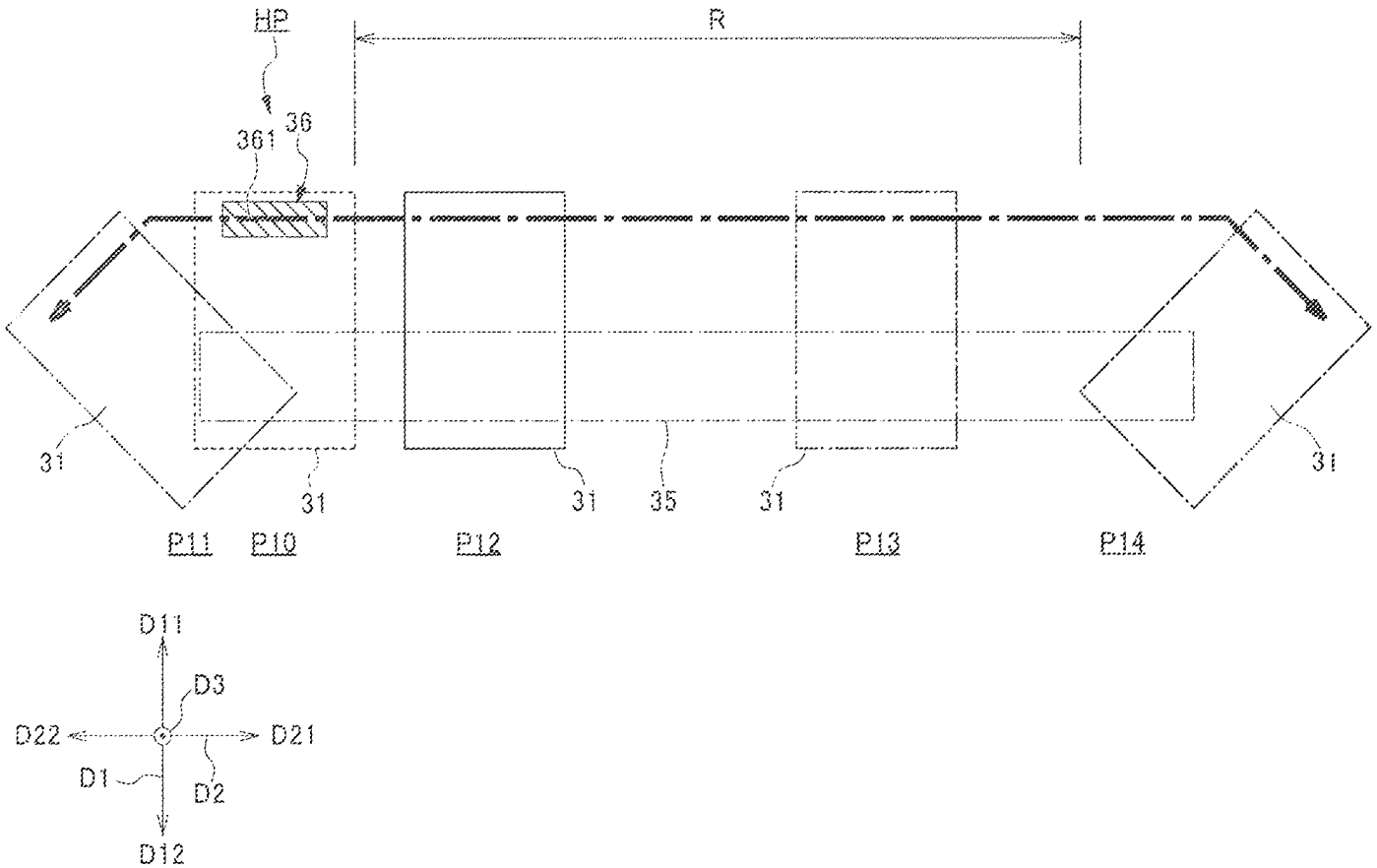
FIG. 6 is a concept diagram for explaining the state when, in the sheet post-processing apparatus shown in FIG. 1, a stapler of the stapling processing portion is moved to first to fourth positions which are stapling processing positions or to an operation position for operating a third switching claw, by a movement driving portion.

As shown in FIG. 6, the stapler 31 is capable of switching the conveying direction D1 of a sheet T by operating the third switching claw 74 via the operation mechanism 36 described later, at an operation position P10. The operation position P10 is between a first position P11 for executing the oblique end stapling processing, and a second position P12 which is one of a second position P12 and a third position P13 for executing the two-point stapling processing, that is closer to the first position P11.

Normally, the movement base point (home position) of the stapler 31 is a position indicated by HP in FIG. 6. The home position HP is also the operation position P10. The stapler 31 is moved to the operation position P10 (home position HP) by the movement driving portion 35, and operates the operation mechanism 36, thereby causing the third switching claw 74 to switch the conveying direction of a sheet T.

Owing to the above configuration, it is possible to abolish the use of a dedicated driving source for causing the third switching claw 74 to switch the conveying direction of a sheet T. As a result, the whole size of the sheet post-processing apparatus 1 and the cost thereof can be reduced.

In addition, while the stapler 31 is moved to the first position P11 or to the second position P12 and the third position P13 and then is executing the stapling processing, i.e., the oblique end stapling processing or the two-point stapling processing, the stapler 31 is not placed (moved) at the operation position P10. Therefore, the stapler 31 can be prevented from erroneously or unnecessarily operating the third switching claw 74. In addition, in the case of the two-point stapling processing, the stapler 31 is moved between two stapling positions of the second position P12 and the third position P13. Therefore, also in this case, the stapler 31 does not cause the third switching claw 74 to perform unnecessary switching operation.

When the stapler 31 is moved to the operation position P10 (home position HP) to perform switching operation of the third switching claw 74 via the operation mechanism 36, the third switching claw 74 switches the conveying direction of a sheet T so as to convey the sheet T through the third conveying path L3 to the sheet folding processing portion 2.

Thus, when the stapler 31 does not perform the stapling processing which is its original function, the stapler 31 can be used (utilized) for switching the conveying direction of a sheet T.

The operation mechanism 36 that operates the third switching claw 74 is configured as follows.

As shown in FIGS. 6, 8, 9, 12, 13, and 16, the operation mechanism 36 is placed at a position that is in the vicinity of an end portion of the sheet post-processing apparatus 1 in the perpendicular back-side direction D22 and is outside a region R where a sheet T is conveyed. Therefore, the operation mechanism 36 does not hinder conveyance of a sheet T, and maintenance work such as inspection or maintenance of the operation mechanism 36 is facilitated. The operation mechanism 36 is mainly composed of an actuation lever 361, a link portion 362, and a restoration spring 363.

As shown in FIGS. 8 to 16, the actuation lever 361 is formed in a bent planar shape. A bracket 364 and a fulcrum shaft 365 are provided on the lower side of the base member 33. The actuation lever 361 is attached on the lower side of the base member 33 via the bracket 364 and the fulcrum shaft 365 at an inner end portion 361*a* in the perpendicular direction D2. Thus, the actuation lever 361 can swing in the up-down direction D3 around the fulcrum shaft 365. An outer end portion 361*b* of the actuation lever 361 in the perpendicular direction D2 is provided on the upper side of the base member 33 through a through-hole 331 of the base member 33. An intermediate portion 361*c* between the inner end portion 361*a* and the outer end portion 361*b* of the actuation lever 361 is bent substantially in a V shape so as to protrude downward under the base member 33.

When the stapler 31 is positioned at, for example, the first position P11, the second position P12, or the third position P13, the substantially V-shaped intermediate portion 361*c* protrudes to be lower than an upper surface 311*a* of the stapler main body portion 311 of the stapler 31. When the stapler 31 is moved to the operation position P10 (home position HP), the upper surface 311*a* of the stapler main body portion 311 comes into contact with the substantially V-shaped intermediate portion 361*c*, whereby the actuation lever 361 swings in the up direction D31 around the fulcrum shaft 365. Thus, the outer end portion 361*b* of the actuation lever 361 is pushed up in the up direction D31.

As shown in FIGS. 8 to 16, the link portion 362 is provided above the actuation lever 361. The link portion 362 includes a first link piece 362*a*, and a second link piece 362*b* contacting the upper surface of the outer end portion 361*b* of the actuation lever 361. The link pieces 362*a* and 362*b* are positioned to be perpendicular to each other. A sheet branch guide 742 supports a plurality of third switching claws 74, and swings integrally with the plurality of third switching claws 74 around a fulcrum shaft 741. The first link piece 362*a* is joined with an edge portion of the sheet branch guide 742.

The restoration spring 363 is provided in a tense state between the base member 33 and an extended end portion 362*c* that extends outward from the second link piece 362*b* of the link portion 362. The restoration spring 363 is energized such that the second link piece 362*b* of the link portion 362 is always in contact with the outer end portion 361*b* of the actuation lever 361.

The operation mechanism 36 mainly composed of the actuation lever 361, the link portion 362, and the restoration spring 363 as described above is configured to allow the stapler 31 to operate the third switching claw 74 by the movement driving portion 35, thereby switching the conveying direction of a sheet T between the state to convey the sheet T to the fourth conveying path L4 and the state to convey the sheet T to the sheet folding processing portion 2.

Next, with reference to FIGS. 8 to 16, the details of the operation of the sheet post-processing apparatus 1 of the present embodiment will be described.

When a sheet T introduced into the sheet post-processing apparatus 1 is conveyed to the stapling processing portion 3 as shown in FIG. 2, when a sheet T introduced into the sheet post-processing apparatus 1 waits aside as shown in FIG. 3, and when the stacking processing is performed to overlay a sheet T introduced into the sheet post-processing apparatus 1 on a waiting sheet T as shown in FIG. 4, the stapler 31 is positioned (stopped) at the home position HP as shown in FIG. 6. In addition, as shown in FIGS. 6, 8 to 11, and 16, when the stapler 31 is executing the stapling processing, i.e., the oblique end stapling processing or the two-point stapling processing, the stapler 31 is positioned (stopped) at the first position P11 (or the fourth position P14) or at the second position P12 and the third position P13.

When a stapling mode of the oblique end stapling processing or the two-point stapling processing is started, the stapler 31 moves from the home position HP to the corresponding position before a sheet T reaches the stapling processing portion 3. In the case of the oblique end stapling processing, the position of the movement destination is the first position P11 or the fourth position P14, and in the case of the two-point stapling processing, the position of the movement destination is the second position P12 which is the first stapling position.

Figure 10:
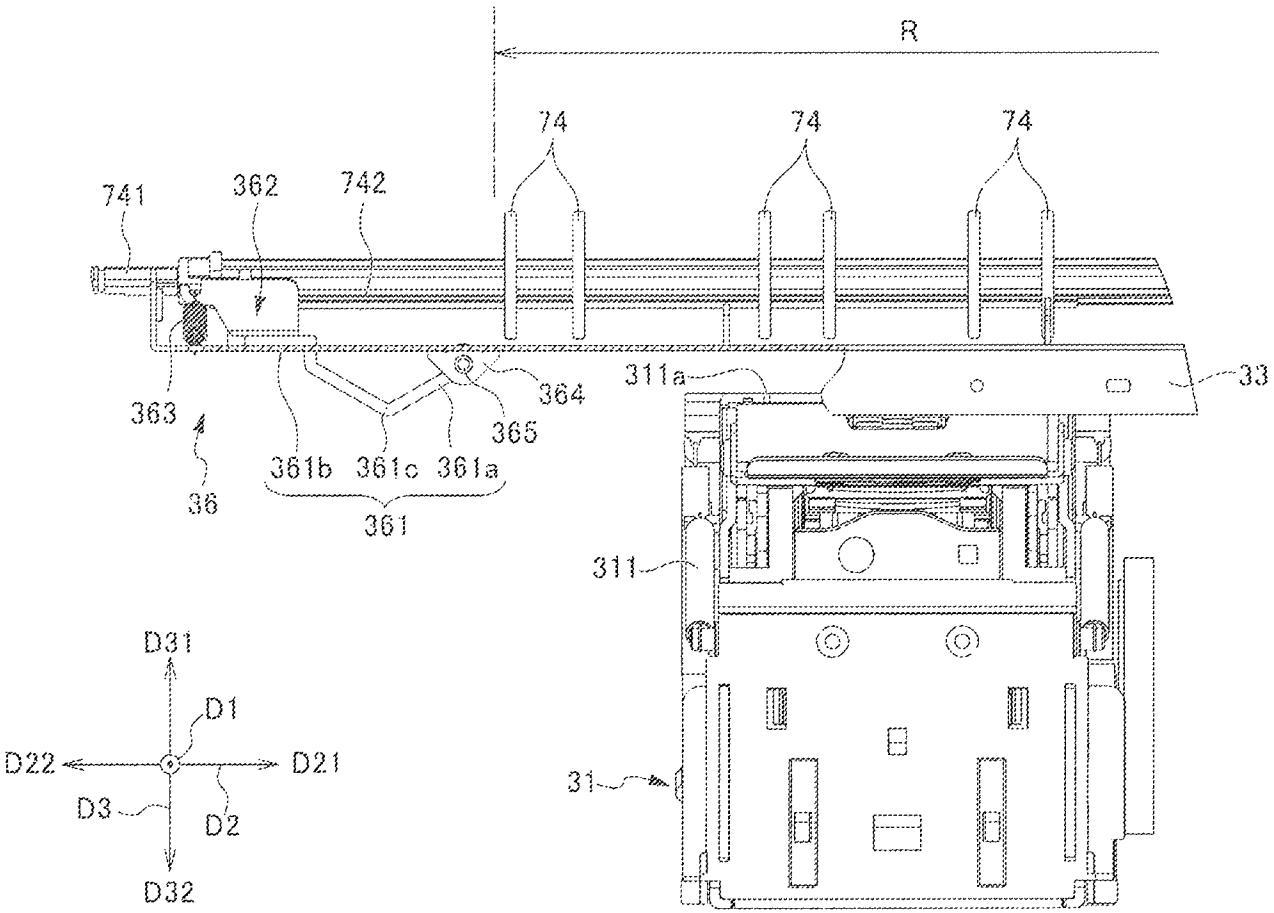
FIG. 10 is a front view of a specific part in the state shown in FIG. 9.
Figure 11:
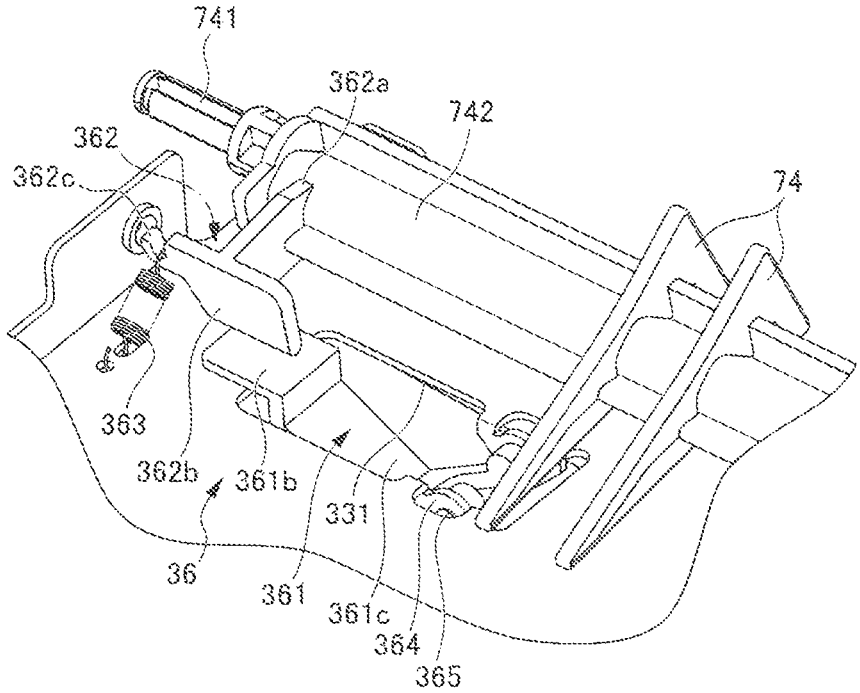
FIG. 11 is an enlarged perspective view of a specific part showing the state of an operation mechanism in the state shown in FIG. 10.
Figure 11:
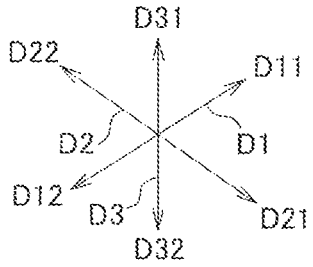

In these cases, the stapler main body portion 311 of the stapler 31 is away from the operation mechanism 36 (see FIGS. 10 and 11). Therefore, in the actuation lever 361 of the operation mechanism 36, the intermediate portion 361*c* is positioned below the base member 33 and the outer end portion 361*b* is positioned above the base member 33. Therefore, in the case where the home position is the home position HP, when the oblique end stapling processing is executed and when the two-point stapling processing is executed, the stapler 31 does not operate the operation mechanism 36.

In addition, the link portion 362 of the operation mechanism 36 is pushed down so that the second link piece 362*b* comes into contact with the outer end portion 361*b* of the actuation lever 361 by the energizing force of the restoration spring 363. Thus, as shown in FIGS. 2 to 4, the third switching claw 74 is kept in an orientation corresponding to a predetermined conveying direction, together with the sheet branch guide 742.

Then, as shown in FIG. 5, after a sheet T is introduced into the sheet post-processing apparatus 1 and then processed by the stacking processing, when the sheet T is to be conveyed to the sheet folding processing portion 2, as shown in FIGS. 6 and 12 to 14, the stapler 31 is moved to the home position HP (operation position P10) by the movement driving portion 35.

Figure 14:
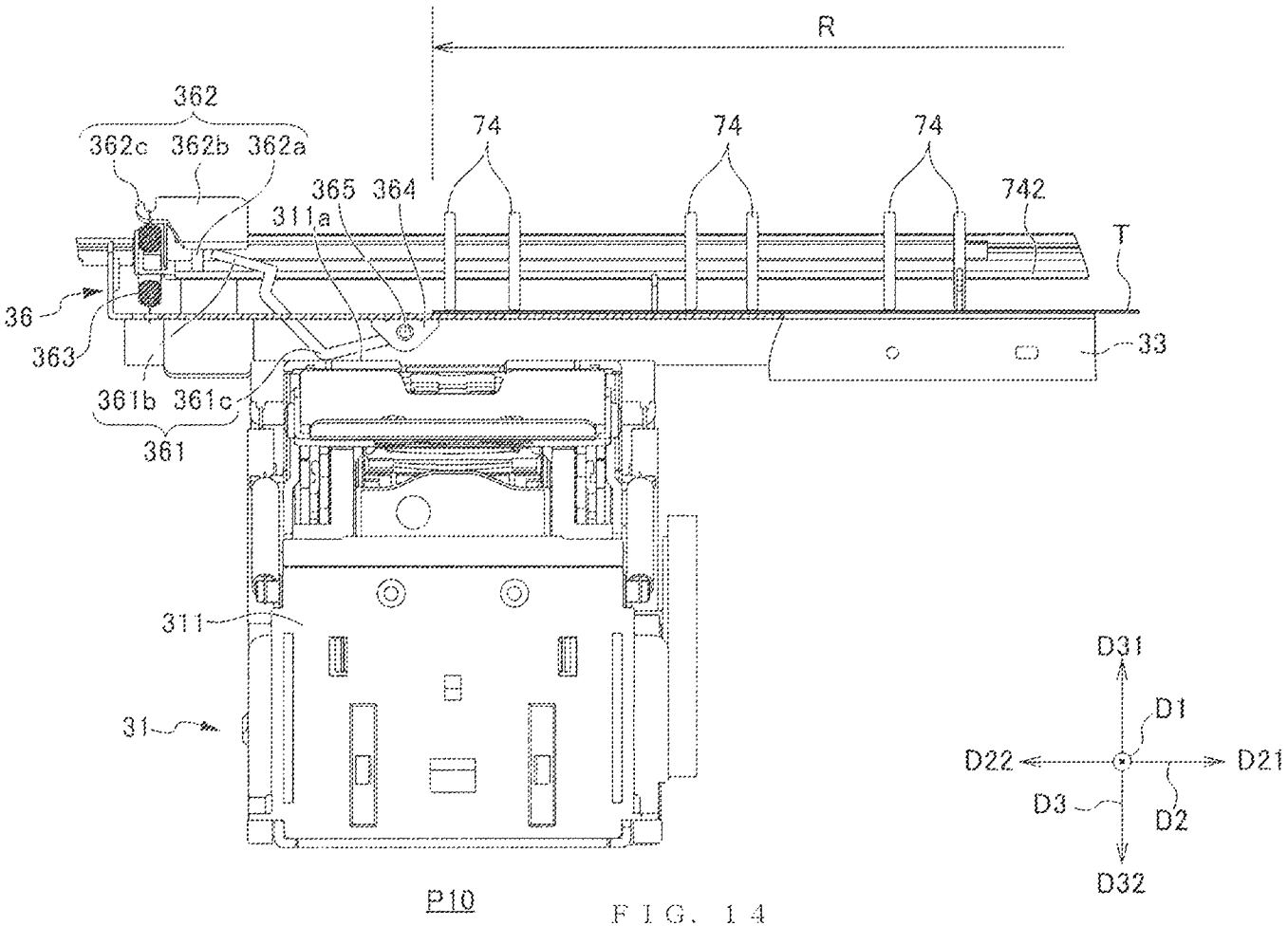
FIG. 14 is a front view of a specific part in the state shown in FIG. 13.
Figure 15:
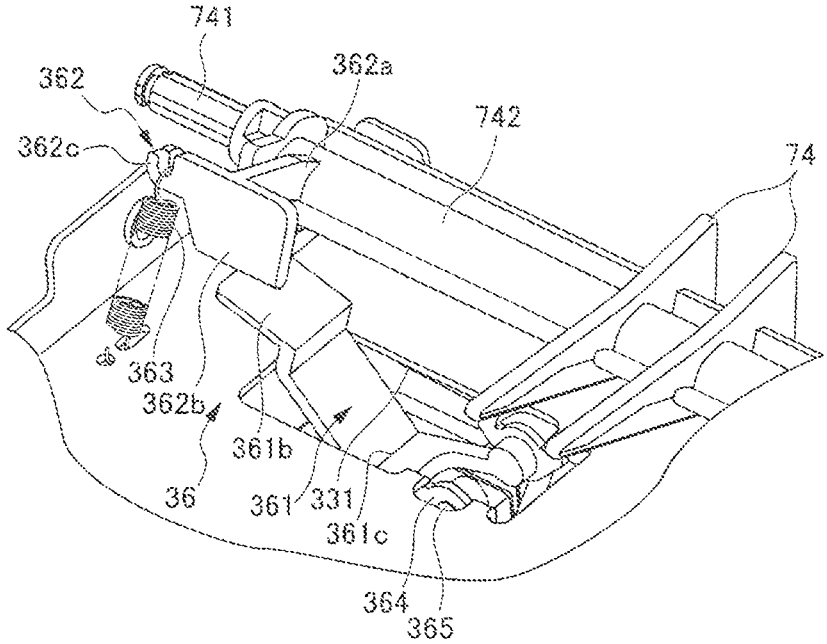
FIG. 15 is an enlarged perspective view of a specific part showing the state in which the operation mechanism operates the third switching claw in the state shown in FIG. 14.
Figure 15:
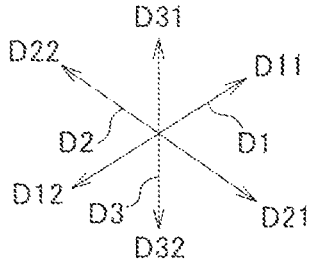

When the stapler 31 is moved to the operation position P10, as shown in FIGS. 14 and 15, the upper surface 311*a* of the stapler main body portion 311 comes into contact with the intermediate portion 361*c* of the actuation lever 361 of the operation mechanism 36. Therefore, the actuation lever 361 swings in the up direction D31 around the fulcrum shaft 365 so that the outer end portion 361*b* is pushed up in the up direction D31. As the outer end portion 361*b* of the actuation lever 361 is pushed up, the link portion 362 of the operation mechanism 36 is displaced in the up direction D31 against the energizing force of the restoration spring 363.

Figure 12:
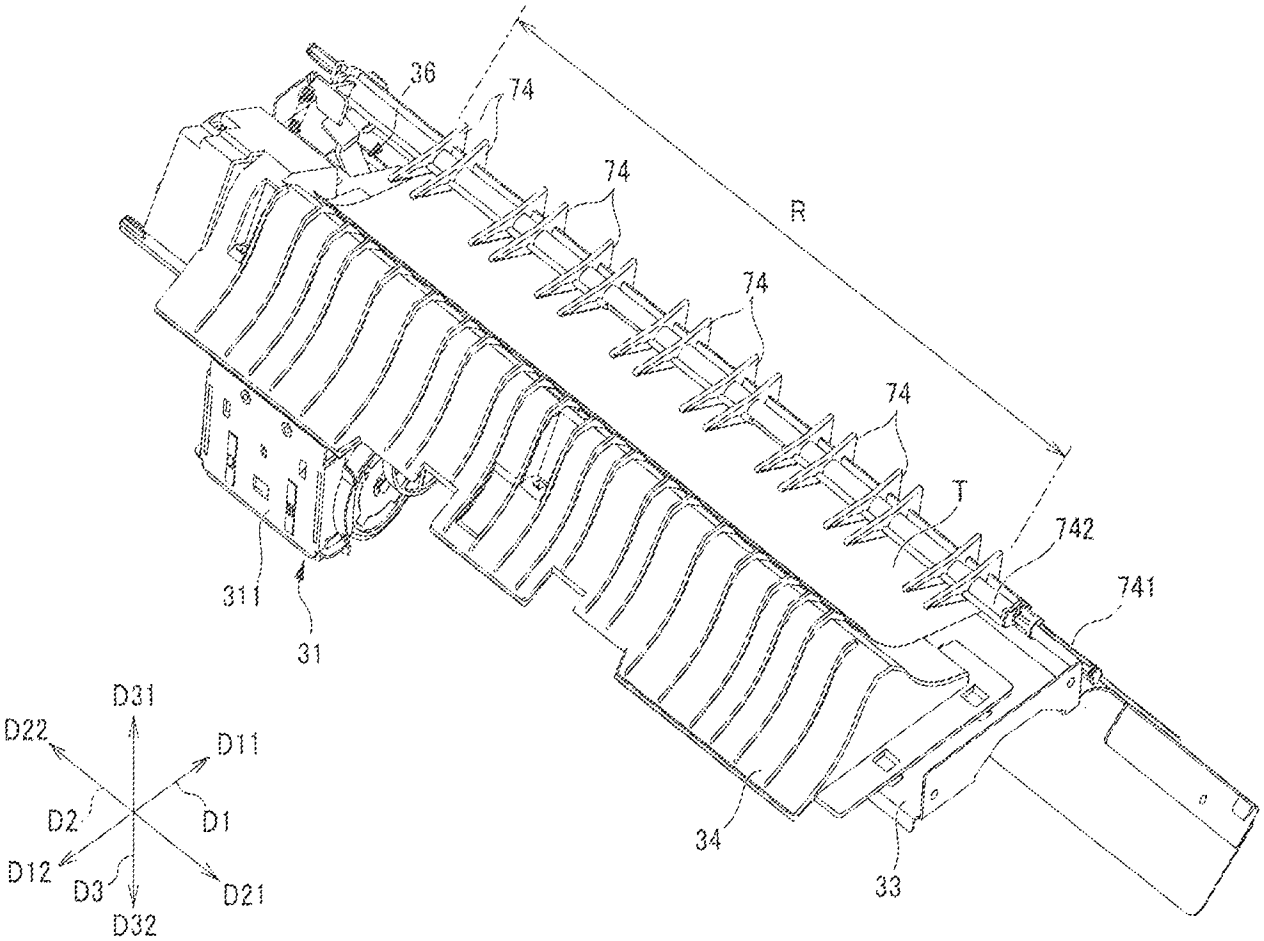
FIG. 12 is a perspective view showing the state in which the third switching claw is operated by movement of the stapler of the sheet post-processing apparatus shown in FIG. 1, as seen from above.
Figure 13:
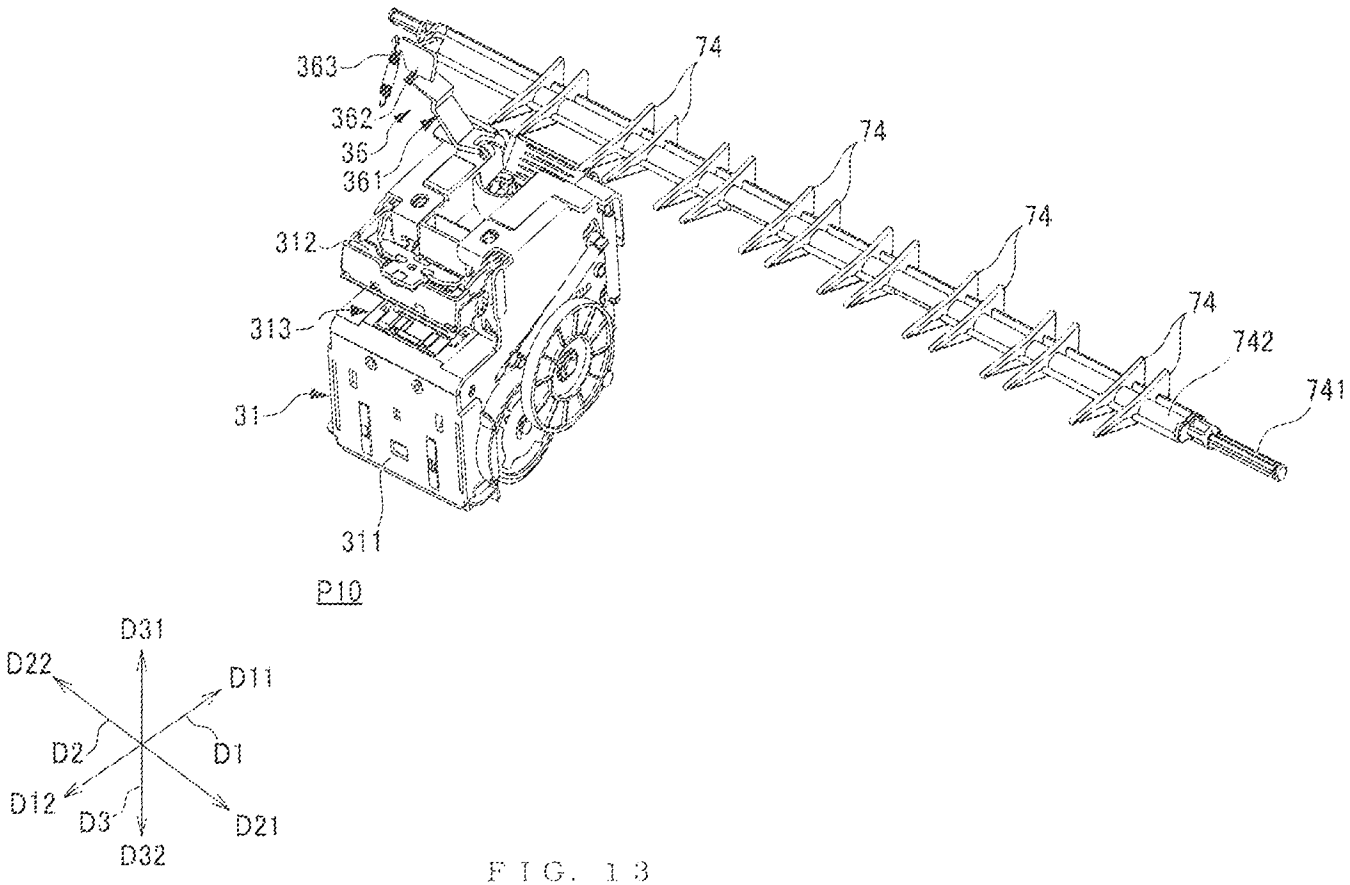
FIG. 13 is a perspective view showing the state in which the conveying guide and the base member composing the third conveying path are removed from the state shown in FIG. 12.

As a result, the third switching claw 74 swings around the fulcrum shaft 741, together with the sheet branch guide 742, to be switched to the orientation for conveying the sheet T processed by the stacking processing to the sheet folding processing portion 2 as shown in FIGS. 12 and 14.

Figure 16:
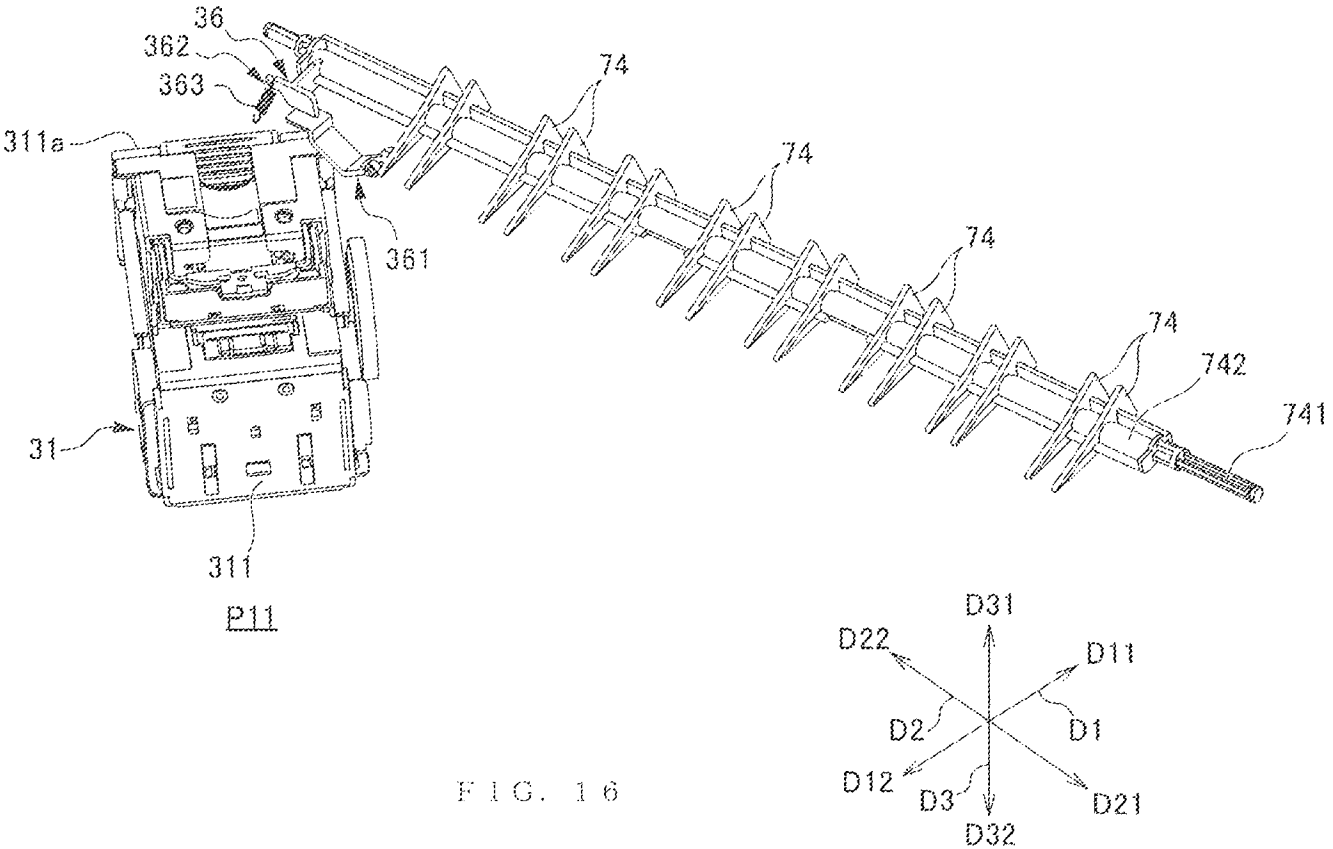
FIG. 16 is a perspective view (corresponding to FIG. 9) showing the state in which the stapler of the sheet post-processing apparatus shown in FIG. 1 is present at the position for the oblique end stapling processing, as seen from above.

In the state in which a sheet T introduced into the sheet post-processing apparatus 1 has been conveyed to the stapling processing portion 3, when the oblique end stapling processing is to be executed, as shown in a dashed-dotted line in FIG. 6 and in FIG. 16, the stapler 31 is moved to the first position P11 by the movement driving portion 35, rotated around a virtual rotational axis extending in the up-down direction D3, and then kept in an inclined state by a predetermined angle with respect to the conveying direction D1 of the sheet T. In this state, the sheet T inserted into the sheet insertion concave portion 313 of the stapler 31 is held between the stapler main body portion 311 and the clincher 312, and then moved in the perpendicular direction D2 to a position that allows a staple SP to be driven. Then, a staple SP is driven in the vicinity of a corner of the sheet T, whereby the oblique end stapling processing is executed as shown in FIG. 7A.

In the state in which a sheet T introduced into the sheet post-processing apparatus 1 has been conveyed to the stapling processing portion 3, when the two-part stapling processing is to be executed, as shown in a solid line and a two-dotted dashed line in FIG. 6, the stapler 31 is moved to the second position P12 and then the third position P13 by the movement driving portion 35. At each of the second position P12 and the third position P13, the sheet T inserted into the sheet insertion concave portion 313 of the stapler 31 is hold between the stapler main body portion 311 and the clincher 312, and then a staple SP is driven into each of two portions of the sheet T along the edge Te in the perpendicular direction D2, whereby the two-point stapling processing is executed as shown in FIG. 7B.

Thus, a preferred embodiment of the present disclosure has been described. However, the present disclosure is not limited to the above embodiment, and various modes can be employed.

In the above embodiment, the case where a switching member that switches the conveying direction of a sheet T is the third switching claw 74, has been described, but the switching member is not limited thereto. For example, the switching member may be the first switching claw 72 and the second switching claw 73.

In the above embodiment, the operation mechanism 36 is mainly composed of the actuation lever 361, the link portion 362, and the restoration spring 363, but is not limited thereto. The operation mechanism 36 only needs to be capable of operating the third switching claw 74 (switching member) along with movement of the stapler 31. For example, the actuation lever 361 may be omitted.

In the above embodiment, as shown in FIG. 7A, the oblique end stapling processing drives a staple SP in the vicinity of a corner of a sheet T in the perpendicular back-side direction D22 such that the staple SP is inclined by a predetermined angle with respect to the conveying direction D1. However, the oblique end stapling processing is not limited thereto. The oblique end stapling processing may drive a staple SP in the vicinity of a corner of a sheet T in the perpendicular near-side direction D21 such that the staple SP is inclined by a predetermined angle with respect to the sheet conveying direction D1.

In this case, instead of the first position P11 of the stapler 31, as shown in FIG. 6, the fourth position P14 of the stapler 31 is set at the end portion in the perpendicular near-side direction D21, and the movement driving portion 35 is configured to operate so as to incline the stapler 31 by a predetermined angle with respect to the conveying direction of a sheet T, at the fourth position P14.

The home position of the stapler 31 is not limited to the home position HP of the above embodiment, but may be, for example, the first position P11 or the second position P12.

In the above embodiment, a processing portion that mainly performs processing other than the stapling processing of driving a staple SP into a sheet T by the stapler 31 is the sheet folding processing portion 2, but is not limited thereto. Such processing portions that mainly perform processing other than the stapling processing include a processing portion that does not perform the stapling processing at all, and a processing portion that is capable of performing the stapling processing and has another main function.

The type of the sheet post-processing apparatus is not particularly limited as long as the sheet post-processing apparatus can perform the various types of post-processing for a sheet.

The type of the image forming apparatus is not particularly limited, but may be a copy machine, a printer, a facsimile, or a multifunction peripheral including them.

The sheet is not limited to a paper sheet, but may be, for example, a film sheet.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A sheet post-processing apparatus comprising:

a switching member that switches the conveying direction of a sheet introduced from an image forming apparatus;

a stapler that staples a bundle of sheets obtained by performing stacking processing for a plurality of the sheets introduced from the image forming apparatus; and a movement driving portion that moves the stapler, wherein the stapler operates the switching member by being moved by the movement driving portion, thereby switching the conveying direction of the sheet.

2. The sheet post-processing apparatus according to claim 1, wherein the stapler is capable of executing end stapling processing of stapling the vicinity of a corner of the sheet, and two-point stapling processing of stapling two portions along an edge of the sheet, and the stapler operates the switching member at an operation position defined between a first position for executing the end stapling processing and one of second positions for executing the two-point stapling processing, that is closer to the first position.

3. The sheet post-processing apparatus according to claim 2, wherein when the stapler operates the switching member, the switching member switches the conveying direction of the sheet so as to convey the sheet to a processing portion that mainly performs processing other than stapling processing of stapling the sheet by the stapler.

4. The sheet post-processing apparatus according to claim 3, wherein a mechanism that operates the switching member is provided outside a region where the sheet is conveyed.

5. The sheet post-processing apparatus according to claim 2, wherein a mechanism that operates the switching member is provided outside a region where the sheet is conveyed.

6. The sheet post-processing apparatus according to claim 1, wherein when the stapler operates the switching member, the switching member switches the conveying direction of the sheet so as to convey the sheet to a processing portion that mainly performs processing other than stapling processing of stapling the sheet by the stapler.

7. The sheet post-processing apparatus according to claim 6, wherein a mechanism that operates the switching member is provided outside a region where the sheet is conveyed.

8. The sheet post-processing apparatus according to claim 1, wherein a mechanism that operates the switching member is provided outside a region where the sheet is conveyed.

9. An image forming apparatus comprising:

an image forming apparatus main body having an image forming portion that forms an image on a sheet; and a sheet post-processing apparatus, wherein the sheet post-processing apparatus includes:

a switching member that switches the conveying direction of the sheet introduced from the image forming apparatus;

a stapler that staples a bundle of the sheets obtained by performing stacking processing for a plurality of the sheets introduced from the image forming apparatus; and a movement driving portion that moves the stapler, and the stapler operates the switching member by being moved by the movement driving portion, thereby switching the conveying direction of the sheet.

10. The image forming apparatus according to claim 9, wherein the stapler is capable of executing end stapling processing of stapling the vicinity of a corner of the sheet, and two-point stapling processing of stapling two portions along an edge of the sheet, and the stapler operates the switching member at an operation position between a first position for executing the end stapling processing and one of second positions for executing the two-point stapling processing, that is closer to the first position.

11. The image forming apparatus according to claim 10, wherein when the stapler operates the switching member, the switching member switches the conveying direction of the sheet so as to convey the sheet to a processing portion that mainly performs processing other than stapling processing of stapling the sheet by the stapler.

12. The image forming apparatus according to claim 11, wherein a mechanism that operates the switching member is provided outside a region where the sheet is conveyed.

13. The image forming apparatus according to claim 10, wherein a mechanism that operates the switching member is provided outside a region where the sheet is conveyed.

14. The image forming apparatus according to claim 9, wherein when the stapler operates the switching member, the switching member switches the conveying direction of the sheet so as to convey the sheet to a processing portion that mainly performs processing other than stapling processing of stapling the sheet by the stapler.

15. The image forming apparatus according to claim 14, wherein a mechanism that operates the switching member is provided outside a region where the sheet is conveyed.

16. The image forming apparatus according to claim 9, wherein a mechanism that operates the switching member is provided outside a region where the sheet is conveyed.

* * * * *